United States Patent [19]

Moreland

[11] Patent Number: 4,541,780

[45] Date of Patent: Sep. 17, 1985

[54] WATER JET AERATOR FOR GANGED OPERATION

[75] Inventor: Gerald W. Moreland, Garden Grove, Calif.

[73] Assignee: Jebadabe International, Inc., Orange, Calif.

[21] Appl. No.: 549,663

[22] Filed: Nov. 7, 1983

[51] Int. Cl.[4] ..... A61H 33/02

[52] U.S. Cl. ..... 417/176; 4/541; 4/542; 137/625.41; 137/889; 137/893; 417/188; 417/190; 417/198

[58] Field of Search ..... 4/541, 542; 137/625.41, 137/893, 889; 417/188, 187, 190, 198, 151, 174, 176

[56] References Cited

U.S. PATENT DOCUMENTS

| | | | |
|---|---|---|---|
| 1,539,846 | 6/1925 | Jansson | 417/188 X |
| 3,380,393 | 4/1968 | Nielsen | 417/190 |
| 3,643,688 | 2/1972 | Meinert | 137/893 |
| 4,264,039 | 4/1981 | Moreland | 4/492 X |
| 4,320,541 | 3/1982 | Neenan | 4/542 X |
| 4,335,854 | 6/1982 | Reynoso . | |
| 4,422,191 | 12/1983 | Jaworski | 4/541 X |
| 4,443,900 | 4/1984 | Remeyer | 4/541 |

*Primary Examiner*—Edward K. Look

*Attorney, Agent, or Firm*—Knobbe, Martens, Olson & Bear

[57] ABSTRACT

There is disclosed herein a spa water jet aerator which proportionately controls the flow of water and air with a single control movement of a valve mechanism. The air and water apertures in the valve body are so shaped and located such that the air flow is controlled so as to be a function of volume of water flow. The function can be varied by varying the shapes and placements of the air and water passageways in the valve body relative to the locations and shapes of the air and water passageways in the aerator body. A key feature is that the air passageway can never be open to any extent when the water passageway is not open sufficiently to create a lower pressure in the mixing chamber than is present in the air supply line since this can lead to malfunction in ganged operation. A separate clamping mechanism allows adjustment of the water flow control valve to be independent of clamping movement of the clamping mechanism. In this way clamping forces causing deformation in the material of the aerator tend not to bind the movement of the valve in its adjustment motion.

12 Claims, 10 Drawing Figures

WATER JET AERATOR FOR GANGED OPERATION

BACKGROUND OF INVENTION

The invention pertains to the field of spas and, more particularly, to field of spa jet aerators.

It has been known in the prior art that when a water jet of a first predetermined cross-sectional area is directed into an aeration chamber of a larger cross-sectional area which is vented to the atmosphere or to an air blower, the water jet venturi effect will tend to suck air into the chamber and entrain bubbles into the water jet stream.

It has also been known to individually control the water and air access to such an aeration chamber or outlet channel. However such mechanisms can become nonfunctional for certain positions of the water and air valves during ganged operation. For example, suppose two aerators are connected to the same air and water manifolds and the water valve in the first is moved to cut off substantially all but not all water flow while the air valve is left open and the other water valve is left fully open. If the air valves of both aerators are left open, then the suction created by the aerator that has the water fully on can suck water from the aeration chamber of the first valve into the air manifold and cause the air passageways to conduct water, thereby destroying the effectiveness of the aerator. It is an object of the present invention to eliminate this problem as well as provide adequate control of the air and water flow to provide a wide variety of mixtures of relative air and water flow.

It is also an object of the present invention to eliminate the problem of binding of the valve adjustment action by distortion and stress in the aerator body and mounting flanges caused by clamping forces of the aerator to the spa wall. This object is accomplished by placement of the valve adjustment threads at a location remote from the location of the threads for the clamping mechanism thereby isolating the valve adjusting action from the stresses of clamping the aerator body to a curved spa wall.

SUMMARY OF THE INVENTION

The water jet aerator of the present invention is comprised of a water channel for guiding water flow, an air channel for guiding air flow, and outlet channel for directing the mixed water and air flow and a valve. The valve body interacts with the aerator air and water passages to simultaneously control the flow of air and water with the air flow maintained as a function of the water flow. The air opening is physically constrained by the structure of the aerator and valve bodies to be a function of the variable water opening. The specific function or proportion of air opening to water opening can be varied by altering the shape and spacing of the air and water passages in the valve body compared to the shape and spacing of the air and water passageway openings in the aerator body from the air and water conduits.

The shape and placement of the air and water passages in the valve body are such that the air passageway is always completely closed when the water passageway is not open sufficiently to create a pressure in the aeration chamber which is lower than the pressure in the air passageway of the aerator body to prevent backflow of water into the air passageway when the air valve is opened. That is, the air passageway will not begin to open until the water passageway is sufficiently open to lower the pressure in the aeration chamber below the pressure in the air passageway. It is possible to have both the air and water passageways partially open simultaneously, but the valve passageways are spaced and shaped such that it is not possible to have a stream of water entering the aeration chamber when the air passage is open where the stream has insufficient velocity to lower the pressure in the aeration chamber sufficiently to eliminate backflow. No opening of the air passage is permitted until enough water flow velocity is available to create air suction.

The aerator body is comprised of a central chamber with a frontal mounting flange and first and second threaded portions. The first threaded portion receives a clamp device to clamp the spa wall between aerator body frontal flange and a flange on the clamp device.

The second threaded portion is removed some distance from the first threaded portion and receives and engages threads on the valve body. The valve can thus be adjusted by turning it into or out of the threads in the valve body to align or misalign the air and water passages in the valve body with the air and water passages in the aerator body.

DETAILED DESCRIPTION OF THE PREFERRED EMBODIMENT

Figure 1:
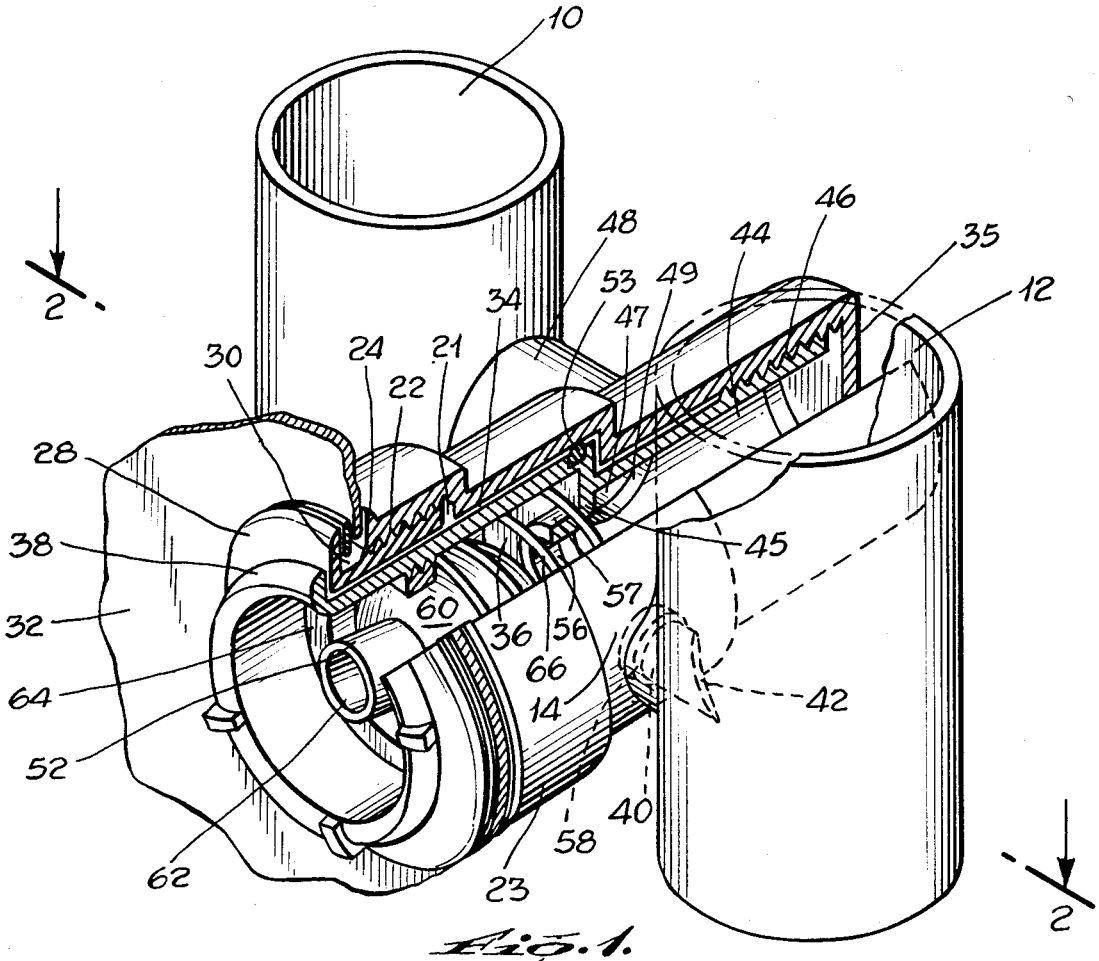
FIG. 1 is a cutaway perspective view of the spa jet aerator of the present invention.
Figure 2:
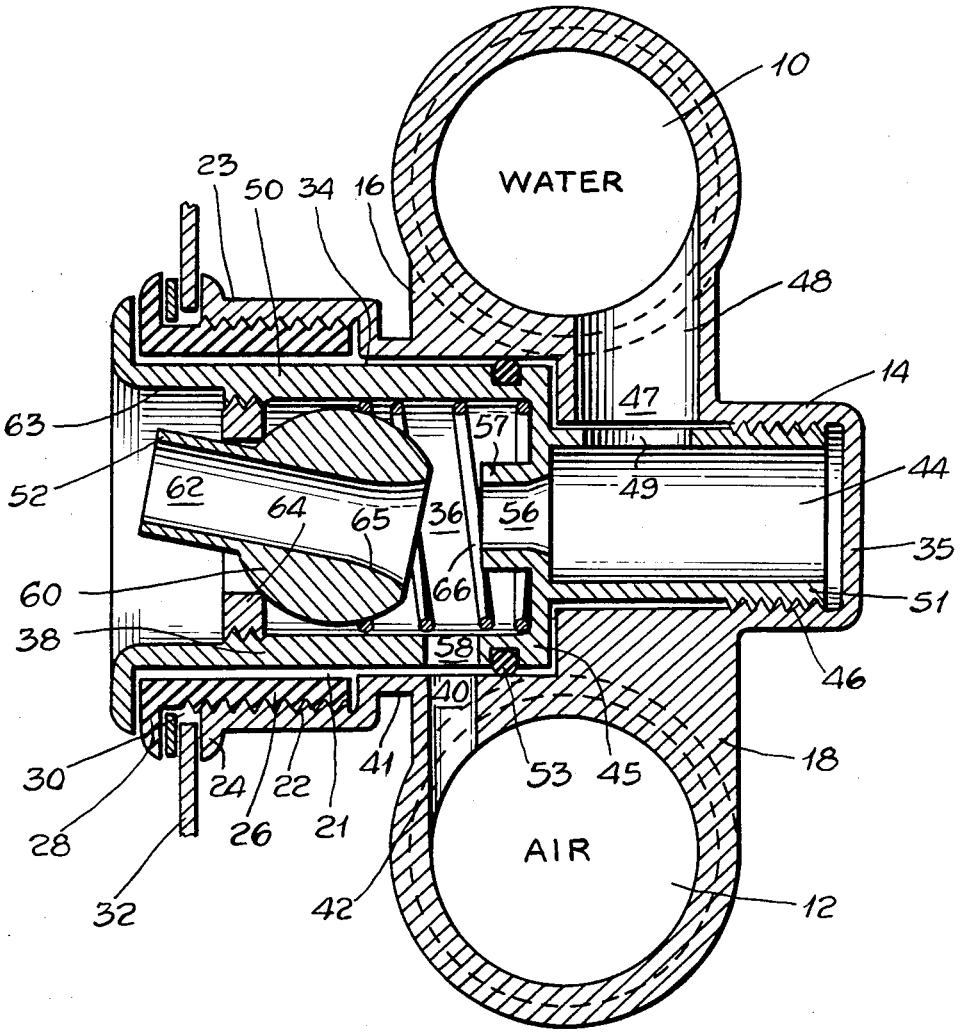
FIG. 2 is a cross-sectional view of the aerator taken along the line 2—2 in FIG. 1.

Referring to FIG. 1 there is shown a cutaway perspective view of the spa aerator of the present invention. FIG. 2 shows a sectional view of the aerator taken along the view line 2—2 in FIG. 1. The aerator is comprised of a water channel 10 and an air channel 12. The water and air channels 10 and 12 are round plastic conduits in the preferred embodiment which are integrally molded into an aerator body 14. The water 10 is joined to the aerator body 14 by a pylon 16 while the air channel 12 is connected to the aerator body 14 by a pylon 18.

The aerator body 14 has a hollow central chamber comprising three different sections, each section having a different diameter. The first section 21 has the largest diameter and is defined by a circular wall 23 with a threaded portion 22 on the inside wall of the chamber. The first chamber 21 terminates on one end in a frontal annular flange 24.

The flange 24 serves as a stop means for use in clamping the aerator body 14 to the wall 32 of a spa. A clamp is formed between a threaded, cylindrical clamping bushing 26 having a clamping collar 28 and the annular flange 24. The bushing 26 has approximately the same outside diameter as the inside diameter of the threaded portion 22 on the inside wall of the first chamber 21. The bushing 26 threads into the threads 22, and a gap 30 is thereby formed between the collar 28 and the frontal flange 24. By threading the bushing 26 into the threads 22, the size of the gap 30 can be reduced or enlarged to clamp differently sized spa walls 32.

A second cylindrical chamber 34 of a reduced diameter joins the first chamber 21 at the end opposite the frontal flange 24. The second chamber 34 serves to house the aerator chamber portion 36 of a valve body 38. The second chamber 34 has an air passageway opening 40 formed in the cylindrical wall 41 which defines the chamber. This air passageway 40 joins, by a passageway 42, to an air conduit 12 which is coupled to the aerator body 14 by a pylon 18. That is, air can flow from the conduit 12 through the passage 42 and opening 40 into the second chamber 34 of the aerator body.

A third cylindrical chamber 44 having a smaller diameter than said second cylindrical chamber 34 joins the second cylindrical chamber to complete the central chamber 20 of the aerator body 14. The third chamber 44 is closed at the end opposite the second chamber 34 by a wall 35. A second threaded portion 46, removed from the first threaded portion 22 by some distance, is formed on the inside wall of the third cylindrical chamber 44. A water passage 47 is formed in the wall of the third cylindrical chamber 44. To the water opening 47 there is fused or integrally formed a water passage 48 in a pylon 16 to establish fluid communication between a water conduit 10 and the third chamber 44. The third chamber 44 receives a water channel portion 51 of the valve body. Fluid communication between the water channel portion 51 and the water passageway 48 is achieved when the opening 47 is aligned with an opening 49 formed in a cylindrical wall which defines the water channel portion 51 of the valve body. There is no end wall in the water channel portion 51 of the valve body since there is no need for one because of a sealing O-ring 53 and the end wall 35 of the aerator body 14. The third chamber 44 is sealed from the second chamber 34 by the end wall 45 of the valve body 38 and the annular sealing O-ring 53 around the perimeter of the valve body 38. A water passage 56 is formed in the end wall 45 of the valve body to join the third chamber of the valve body to the aeration chamber 36 in the valve body. The water passage 56 is shaped as a nozzle with a converging diameter. As water flows through the passage 56 toward the aeration chamber 36, it is restricted into a stream of smaller cross sectional area. This increases the velocity of the stream and lowers the pressure in the aeration chamber 36.

The valve body 38 serves to simultaneously control the flow of water and air from the water conduit 10 and the air conduit 12 through the aerator. The valve body 38 is comprised of the aeration chamber 36 as defined by a cylindrical wall 50 which has an outside diameter which approximately matches the inside diameter of the central chamber 34 except for a small clearance. The outside diameter of the wall 50 also approximately matches the inside diameter of the clamping bushing 26 except for a small clearance. The valve body also has a water channel portion defined by a second cylindrical wall 51 which has an outside diameter which approximately matches the inside diameter of the third chamber 44 of the aerator body. The outside surface of the wall 51 has threads formed therein to engage the threads 46 on the inside surface of the cylindrical third chamber 44.

The aeration chamber 36 is defined by the wall 50, an eyeball-like directional nozzle 60, and an end wall 45 through which there is formed the water passageway 56. The end wall 45 joins the cylindrical wall 50 to form a floor or bottom for the aeration chamber 36. The water passageway 56 is defined by a cylindrical wall 57 which extends from the end wall 45 for a small distance into the aeration chamber 36 to give the water stream emanating from the passageway 56 more direction and definition and to aim the stream toward the opening in the directional nozzle 60. The cross-sectional area of the water passageway 56 is less than the cross-sectional area of the aeration chamber 36 such that an air space is formed in the chamber 36 around the water stream emanating from the water passageway 56.

The wall 50 of the valve body 38 has an air passageway 58 formed therein and a water passageway 49 is formed in the cylindrical wall 51 adjoining the end wall 45 and the cylindrical wall 50. The air passageway 58 is located so as to form a fluid communication path of variable cross-sectional area between said aeration chamber 36 and the passageway 42 in the aerator body, and the water passageway 49 is located so as to form a fluid communication path of variable cross-sectional area between said cylindrical third chamber 44 and the water passageway 48. The variable cross-sectional areas are the result of the state of alignment or misalignment between the passageway 40 and 48 and the openings 58 and 49 in the valve body 38. The alignment of these openings can be adjusted by turning the valve body 38 in the threads 46.

The directional nozzle 52 is attached to a ball element 60 which has a diameter sufficient to approximately match the inside diameter of the cylindrical wall 50. The ball has a fluid passage 62 formed therein for an outlet channel. The fluid passage 62 has a flared portion 65 of a larger diameter than the diameter at the outlet to enable the stream emanating from the water passageway 56 to land inside the passageway 62 as opposed to on the outside of the ball 60 regardless of the angle of the dischasrge nozzle. This tends to minimmize turbulence in the aeration chamber 36. A retaining ring 64 is fastened as by threads to the inside wall surface 63 of the cylindrical wall 50 of the valve body 38. A spring 66 interposed between the ball 60 and the end wall 45 to bias the ball 60 against the retaining ring 64.

OPERATION

The operation of the aerator involves the generation of a suction in the aeration chamber 36 by a fast-moving fluid stream through the venturi shaped water passageway 56. This suction entrains air from the aeration chamber 36 into the water stream as bubbles. The water and bubbles are then ejected from the aerator through the outlet passageway 62.

Figure 3:
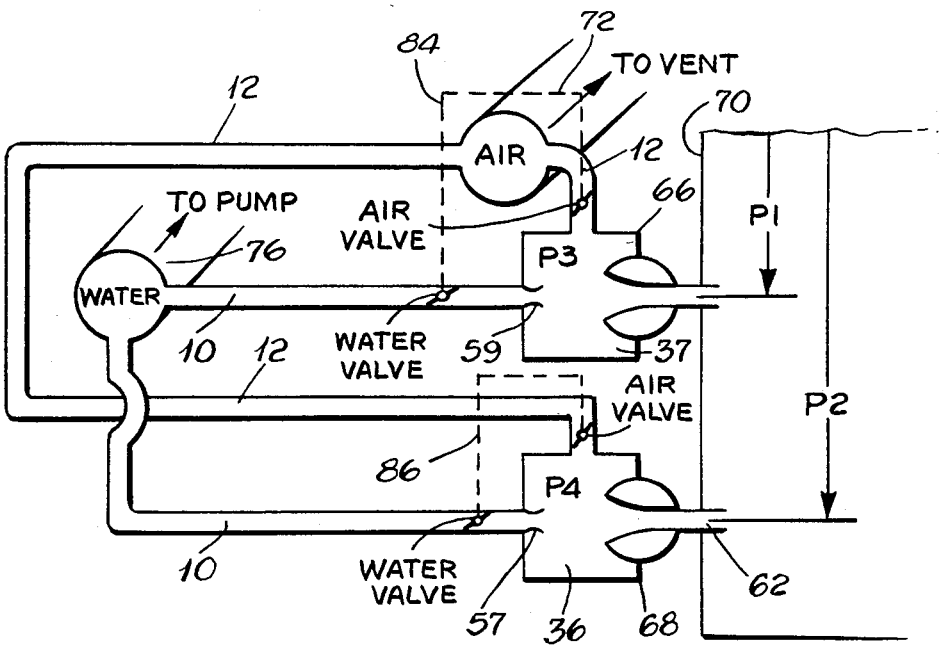
FIG. 3 is a schematic diagram of a typical ganged jet spa aeration system.

Referring to FIG. 3 there is shown a typical ganged installation of several aerators, of which aerators 66 and 68 are typical, arranged around the perimeter of a spa 70. The air conduits 12 of the aerators 66 and 68 are joined to a manifold 72. The manifold 72 can be vented to the atmosphere at a level above the water level in the spa 70 or can be coupled to the output of a blower (not shown). Likewise, the water conduits 10 of the aerators 66 and 68 are coupled to a water pipe 76. The water pipe 76 is coupled to the output of a water pump (not shown) which supplies water under pressure to each aerator on the circuit.

A problem can arise in certain situations if there is independent control of each of the air and water flows in each of the aerators. Assume, for example, that the aerator 66 has its water flow control set to full flow and has its air valve partially or fully open. If the aerator 68 has its water valve open to just a trickle but its air valve is open partially or fully, the aerator 68 will not be generating suction in its aeration chamber while the aerator 66 will be generating suction in its aeration chamber. Because the air valve of the aerator 66 is open, the suction in the aeration chamber of the aerator 66 will be coupled through the manifold 72 to the aeration chamber of the aerator 68 through the open air valve of the aerator 68. But because the aeration chamber of the aerator 68 is filled with water because of insufficient opening of the water valve of the aerator 68 to create outflow through the outlet aperture flow channel 62, this water from the aeration chamber 36 will be sucked into the air manifold 72. This will block free air flow through the manifold 72 to the other aerators on the circuit and will flow into the aeration chamber 37 of the aerator 66 and cause it to stop aerating. To remedy this potential problem, the invention contemplates, in one aspect, a structural relationship between the air and water valves represented schematically by the dotted lines 84 and 86 in FIG. 3. These structural relationships represent selection and arrangement of the structure of the valve and aerator bodies such that the air valves can never open until there is sufficient water flow to insure flow outward from the aeration chamber into the spa. That is, the air valve never opens until sufficient water flow occurs through the aerator nozzle to cause water flow out through the outlet channel 62 into the spa. If the air valves can be opened when the water pump is operating but there is no flow out the outlet channel 62, then water will fill the aeration chambers 36 or 37 under the influence of the static water pressure P1 or P2. Since water seeks its own level, the water will rise up into the air manifold 72 past the open air valve until it reaches its own level unless the air pressure in the manifold 72 is sufficient to overcome the static water head P1 or P2. The invention eliminates the need for an elevated air pressure in the air manifolds, thereby eliminating the need for a blower, since the air valve can never be open unless pressure conditions in the aeration chamber are sufficient to prevent water from entering the air conduit, a condition which is guaranteed if there is water flow out from the aeration chamber into the spa.

Referring to FIGS. 4–7 there is schematically shown the structural relationship between the air and water valving mechanisms in the present invention which eliminates the above-noted problem. In FIGS. 4–7 the circles on the left represent the water passageways 48 and openings 47 (in FIGS. 1 and 2) in the aerator body 14 leading from the water conduits 10 to the third chamber 44. The triangles at the left in FIGS. 4–7 represent the water openings 49 in FIG. 2 in the wall 51 of the valve body 38 adjacent to the water passageway 47. The circles on the right in FIGS. 4–7 represent the air passageway openings 40 in the aerator body 14 coupling the second chamber 34 to the air conduit 12 via the air passageway 42. The triangles represent the air passageway 58 in the wall 50 of the valve body 38 adjacent to the air passageways 42.

The invention provides a structure to couple the process of opening the air passageway to the process of opening the water passageway such that each opens in a predetermined, fixed relationship. The water passageway 48 will be opened when the area of the triangular opening 49 in the valve body 50 partially or fully overlaps the area of the circular water passageway 48. This occurs as the valve body 50 is rotated in the threads 46 to change the relative angular position of the hole 49 in the valve body versus the opening 47 at the end of the water passageway 48.

Figure 8:
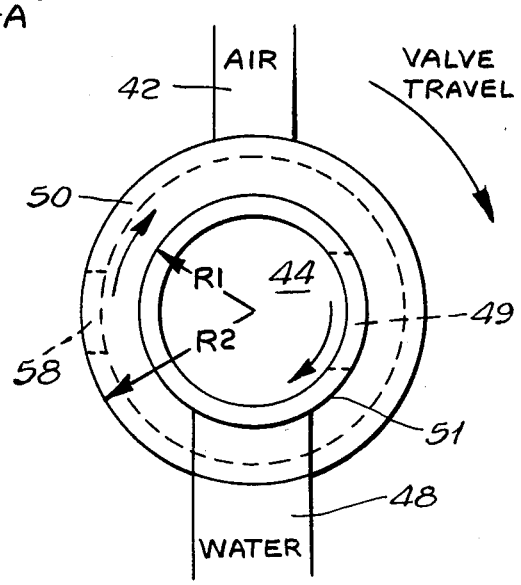
FIG. 8 is an end view of the valve illustrating the reason for the interactions depicted in FIGS. 4–7.

As the hole 49 is rotated toward the water passageway opening 47 the air passageway opening 58 in the wall 50 of the valve body is simultaneously rotated toward the opening 40 at the end of the air passageway 42. Referring to FIG. 8, the relative angular relationship between the holes 49 and 58 in the valve body is defined as is the relative angular relationship between the water passageway 48 and the air passageway 42. As the wall 50 is rotated in the clockwise direction, the hole 49 in the wall 51 moves toward the water passageway 48 while the hole 58 in the wall 50 moves toward the air passageway 42.

These relative movements are shown schematically in FIGS. 4–7 as vertical movement of the triangular-shaped holes 49 and 58 while the circular water and air passageways 48 and 42 remain stationary. As the hole 49 moves through any given distance on the circle having the radius R1, the hole 58 will move a greater distance along the circle having the radius R2 since R2 is greater than R1. In FIGS. 4–7 this relationship is shown in terms of the triangular air hole 58 moving a distance D1 from point A in FIG. 4 to point B in FIG. 7. During the same angular rotation, the hole 49 moves a distance D2 from point C in FIG. 4 to point D in FIG. 7, a distance D2, said distance D2 being less than the distance D1.

Figure 4:
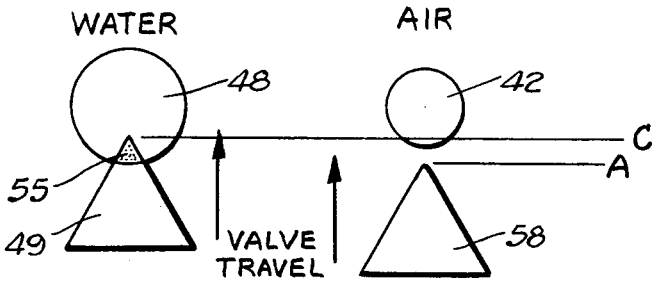
FIGS. 4–7 are symbolic diagrams illustrating the interaction between the air and water passageways in the spa jet aerator body and the corresponding passageways in the valve for various angular positions of the valve.

As shown in FIG. 4, when the water passageway 48 is only slightly open, represented by the stippled area 55, the air passageway is completely closed as indicated by the absence of overlap between the air passageway 42 and the hole 58 in the valve body.

Figure 5:
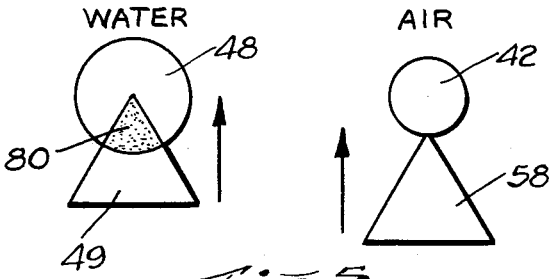

The air passageway does not begin to open until the water passageway reaches the substantially open condition illustrated in FIG. 5. The stippled area 80 represents the percentage of the water passageway which is open as the air passageway begins to open. The percentage of the water passageway that is open before the air passageway is opened can vary from installation to installation depending upon various factors. The amount of the area 80 should be set such that sufficient water flow and velocity occurs in the passage 56 in FIG. 2 to cause outflow from the aeration chamber 36 into the spa before the air valve is open.

Figure 6:
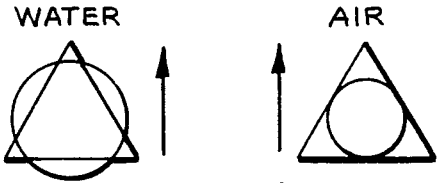

FIG. 6 illustrates the fully open position of the air and water passageways. The positions of openings 49 and 58 in the valve body and the radii R1 and R2 are selected such that the sequence of air and water passageway opening occurs as shown sequentially from FIG. 4 to FIG. 7 with full opening of each occurring simultaneously. At all points in the movement between FIGS. 5 and 6 the air and water passageways are both partially open.

Figure 7:
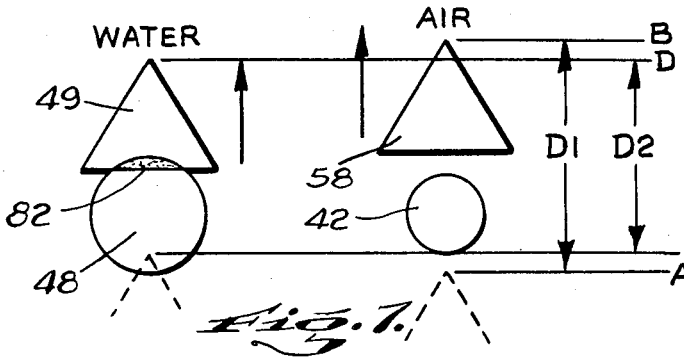

FIG. 7 shows the relative positions of the air and water openings 58 and 49 in the valve body when the water opening 49 is only slightly overlapping the mouth of the water passageway 48 as shown by the stippled area 82. Again, the relative positions of the openings 49 and 58 and the radii R1 and R2 are selected in predetermined fashion. That is, they are selected such that if the direction of rotation of the valve body is counterclockwise instead of clockwise, i.e, holes 49 and 58 move downward in FIGS. 4–7 toward the water and air passageways, then the air passageway will not be opened until sufficient opening of the water passageway occurs to create outflow from the aeration chamber into the spa.

Referring again to FIG. 2, note that the spa wall 32 is clamped between the collar 28 of a clamping bushing 26 and the annular shoulder 24 of the valve body 14. The space 30 between the collar 28 and the annular shoulder 24 in which the spa wall 32 is clamped, is variable. The space 30 is adjusted by turning the clamping bushing 26 in the threads 22.

This clamping mechanism is independent of the valve water and air control mechanism such that the flow of air and water can be controlled without affecting the position or adjustment of the clamping mechanism just described. Because of this independence, the stress and strain in the valve body induced by the tightness of the clamping mechanism will not affect the ease with which the valve can be adjusted. This result occurs because the threads 46 in which the valve body 14 turns are spaced away from the threads 22 where any clamping stress and strain will be centered. Thus, any distortion in the shape of the valve body caused by these clamping forces will usually not distort the threads 46 so as to render turning movements by the valve body 14 in the threads 46 more difficult.

Figure 9:
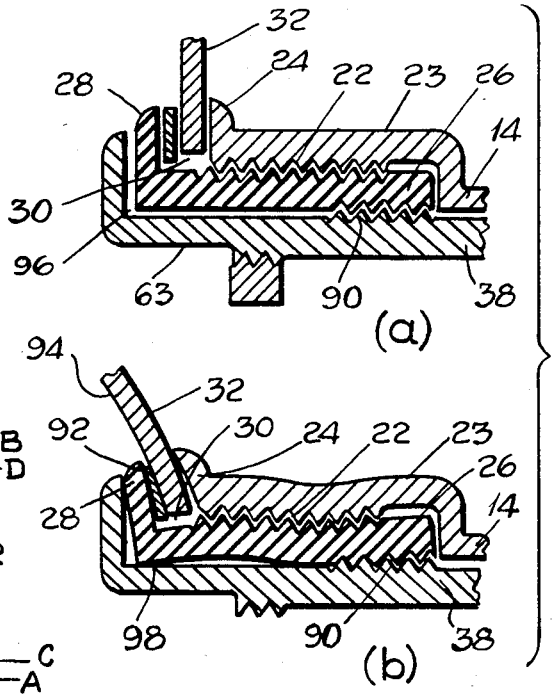
FIGS. 9(*a*) and (*b*) show the effect of clamping the aerator to a curved spa wall on valve body adjusting threads placed too near the clamping mechanism.

This phenomena can be visualized by inspection of FIGS. 9(*a*) and (*b*) which show the type of distortion in the aerator caused by curvature of the spa wall to which the aerator is clamped. FIG. 9(*a*) shows the clamping portion of the aerator clamped to a straight spa wall with the modification that threads 90 have been added to the inside wall of the clamping bushing 26. The threads 90 have been added to illustrate, by contrast, the merits of placing the valve adjusting threads away from the clamping mechanism.

If, as in FIG. 9(*a*), the valve body orientation relative to the aerator body is changed by rotating the valve body 38 in the threads 90, then when the aerator body is clamped to a curved spa wall, the situation in FIG. 9(*b*) could arise.

In FIG. 9(*b*) the curvature of the spa wall 32 when clamped in between the collar 28 of the clamping bushing 26 and the flange 24 of the aerator body 14 exerts forces on the clamping bushing 26 that are coupled through the threads 22 to the aerator body 14. These forces tend to distort the aerator body 14 and the clamping bushing 26 which are generally made of somewhat flexible plastic. FIG. 9(*b*) shows one type of distortion that can occur in this situation. The clamping forces generated by screwing the clamping bushing 28 into the threads 22 tend to cause the collar 28 to be torqued such that inside surface 92 of the collar 28 can be parallel to the spa wall surface 94. But since the spa wall surface 94 is curved toward the surface 92, the resulting torque tends to move the collar 28 toward the centerline of the valve body 38. This strain tends to reduce the clearance at 96 in FIG. 9(*a*) between the clamping bushing 26 and the valve body 38 to the little or no clearance situation depicted at 98 in FIG. 9(*b*). Binding can occur where no clearance exists at 98 causing difficulty in turning the valve body 38 in the threads 90. Further, the torque on the clamping bushing 26 can jam the threads 90 closer together with more force, thereby making it more difficult to turn the two halves of the threads relative to each other. By removing the valve adjusting threads to the position of the threads 46 in FIG. 2, this problem is eliminated.

What is claimed is:

1. A spa water jet aerator comprising:

an aerator body;

an water channel in said aerator body for guiding water flow;

an air channel in said aerator body for guiding air flow; and a valve body movably coupled to said aerator body and having an aeration chamber in fluid communication with said air and water channels, said valve body simultaneously controlling the flow of both water and air through passages in fluid communication with said aeration chamber such that each said passage can be simultaneously partially open in at least one position of said valve body but the air passage can never be open when the water passage is open less than a sufficient amount to cause outflow from said aeration chamber into said spa.

2. An apparatus as defined in claim 1 wherein said valve body controls the simultaneous opening and closing of the passages between said aeration chamber and said water and air channels such that as the water passage is increasingly opened past a predetermined point, the air passage is also increasingly opened as a function of the opening of the water passage.

3. An apparatus as defined in claim 1 or 2 further comprising clamp means adjustable independent of said valve body for allowing said valve body to be adjusted to control the flow of air and water without affecting the position or adjustment of said clamp means and to allow the valve body to be freely adjustable regardless of the tightness of the clamp means.

4. A spa water jet aerator for mounting in a spa wall comprising:

a water channel;

an air channel;

an aerator body having a central chamber connected to said water channel by a water passage and connected to said air channel by an air passage and having a frontal flange area for abutting a spa wall and having a first threaded portion adjacent said frontal flange and having a second threaded portion spaced away from said first threaded portion;

a clamp means threaded into said first threaded portion for clamping said spa wall to said frontal flange; and a valve body having an aeration chamber, said valve body threaded into said second threaded portion of said valve body for interacting with said air and water channels to simultaneously control the flow of water through said water passage and air through said air passage into said aeration chamber such that said air passage and said water passage can be simultaneously partially open but so that said air passage can never be open when said water passage is open less than an amount sufficient to create pressure conditions in said aeration chamber sufficient to prevent water from tending to enter said air channel.

5. An apparatus as defined in claim 4 wherein said valve controls the simultaneous opening and closing of the air and water passages such that as the water passage is increasingly opened past a predetermined point, the air passage is also increasingly opened.

6. An apparatus as defined in claim 4 or 5 wherein said aerator body is comprised of three cylindrical portions each having a different diameter than the others and wherein said first threaded portion is formed inside the portion having the largest diameter and said second threaded portion is formed inside the portion having the smallest diameter.

7. An apparatus as defined in claim 6 wherein said aerator body has openings at the end of said air and water passages and said valve body has openings which interact with the openings in said aerator body to create air and water passageways of adjustable cross-sectional area into said aeration chamber.

8. An apparatus as defined in claim 4 or 5 wherein said valve has at least two positions wherein said air passage is completely closed while said water passage is partially open, wherein each predetermined amount is sufficient to prevent water from tending to enter said air channel.

9. An apparatus as defined in claim 1 or 2 or 4 or 5 wherein said valve body constricts the water flowing out of said water channel into a stream of a first predetermined cross-sectional area and guides said stream into an aeration chamber having a second, larger, predetermined cross-sectional area and wherein said aeration chamber is coupled to said air channel by a passage through said valve body.

10. An apparatus as defined in claim 9 wherein said central chamber has two different chambers, each cylindrical and of a different diameter from the other and wherein said valve body has an aeration chamber having an outside diameter approximately equal to the inside diameter of the bigger of the two chambers and having an air opening in said aeration chamber which interacts with an air opening in the wall of the larger of said chambers, said valve body also having a smaller diameter portion with an outside diameter approximately equal to the inside diameter of the smaller of the two chambers and having a water opening in the wall of said smaller diameter portion which interacts with a water passageway in a wall of the smaller diameter chamber of the aerator body, said smaller diameter portion of said valve body having a water passageway leading into said aeration chamber, which water passageway has a smaller cross-sectional area than the cross-sectional area of the aeration chamber.

11. A spa water jet aerator for mounting in a spa wall comprising:

a valve body; and means for allowing manual regulation for the amount of air flowing through an air passage in the valve body and into a water stream in said valve body, said air flow regulation based upon the flow of said water stream, including means to automatically block all fluid flow through the air passage whenever the water flow is insufficient to create outflow from said water jet aerator into the spa.

12. A spa water jet aerator system comprising:

a water manifold;

an air manifold at or below atmospheric pressure;

first and second water jets, each including an aerator body with a suction chamber, said suction chamber including an air inlet passage connected to said air manifold and a water nozzle connected to said water manifold, said first and second water jets aerating two water streams;

means located on said first water jet for automatically preventing said first water jet from allowing the vacuum generated by said second water jet in aerating a water stream from drawing water from said first jet into said air manifold, whenever there is insufficient water flow through the water nozzle of said first water jet to cause outflow from the suction chamber of said first water jet into said spa.

* * * * *